US006752667B2

(12) United States Patent
Ferderer

(10) Patent No.: US 6,752,667 B2
(45) Date of Patent: Jun. 22, 2004

(54) ELECTRICAL CONNECTION ELEMENT AND A HOUSING FOR AN ELECTRICAL CONNECTION ELEMENT

(75) Inventor: Albert Ferderer, Espelkamp (DE)

(73) Assignee: Harting Electric GmbH & Co. KG (DE)

( * ) Notice: Subject to any disclaimer, the term of this patent is extended or adjusted under 35 U.S.C. 154(b) by 0 days.

(21) Appl. No.: 10/238,120

(22) Filed: Sep. 10, 2002

(65) Prior Publication Data

US 2003/0054702 A1 Mar. 20, 2003

(30) Foreign Application Priority Data

Sep. 14, 2001 (DE) ..... 101 45 324

(51) Int. Cl.[7] ..... H01R 4/48
(52) U.S. Cl. ..... 439/729; 439/836; 439/863
(58) Field of Search ..... 439/725, 729, 439/835, 836, 393, 863, 861, 862

(56) References Cited

U.S. PATENT DOCUMENTS

| | | | | | |
|---|---|---|---|---|---|
| 3,071,750 | A | * | 1/1963 | Heselwood | 439/391 |
| 3,458,780 | A | * | 7/1969 | McDaniel | 257/711 |
| 3,744,006 | A | * | 7/1973 | O'Loughlin | 439/393 |
| 4,097,101 | A | * | 6/1978 | Holt et al. | 439/82 |
| 4,162,819 | A | * | 7/1979 | Eisert | 439/711 |
| 4,175,810 | A | * | 11/1979 | Holt et al. | 439/82 |
| 4,215,911 | A | | 8/1980 | Dittmann et al. | 439/263 |
| 4,530,560 | A | * | 7/1985 | Weidler | 439/426 |
| 4,687,273 | A | * | 8/1987 | Pranch | 439/411 |
| 4,775,335 | A | * | 10/1988 | Havel | 439/820 |
| 4,822,288 | A | * | 4/1989 | Conley | 439/84 |
| 5,030,134 | A | | 7/1991 | Plosser | 439/434 |

FOREIGN PATENT DOCUMENTS

| | | | |
|---|---|---|---|
| DE | 1 229 609 | 7/1964 | |
| DE | 34 47 135 A1 | 5/1984 | H01R/4/48 |
| DE | 40 20 339 A1 | 6/1990 | H01R/9/03 |
| FR | 1.324.706 | 6/1962 | |

* cited by examiner

*Primary Examiner*—Tulsidas Patel
(74) *Attorney, Agent, or Firm*—Hayes Soloway P.C.

(57) ABSTRACT

For connection elements, which are designed as pin contacts or contact tubes and disposed in an insulating housing, for the electrical contacting of the respective connection ends with an electrical conductor having a plurality of strands it is proposed to provide the connection ends with a structure, which is shaped in a saw-tooth-like manner and is surrounded by a slotted sleeve, wherein into the slot of the latter a wedge element is insertable so that, in the open state of the sleeve, the strands are insertable into the gap between saw-tooth contour and sleeve and, when the wedge element is removed, the strands are pressed into the saw-tooth contour by the resiliently designed sleeve.

18 Claims, 9 Drawing Sheets

ELECTRICAL CONNECTION ELEMENT AND A HOUSING FOR AN ELECTRICAL CONNECTION ELEMENT

Figure 1:
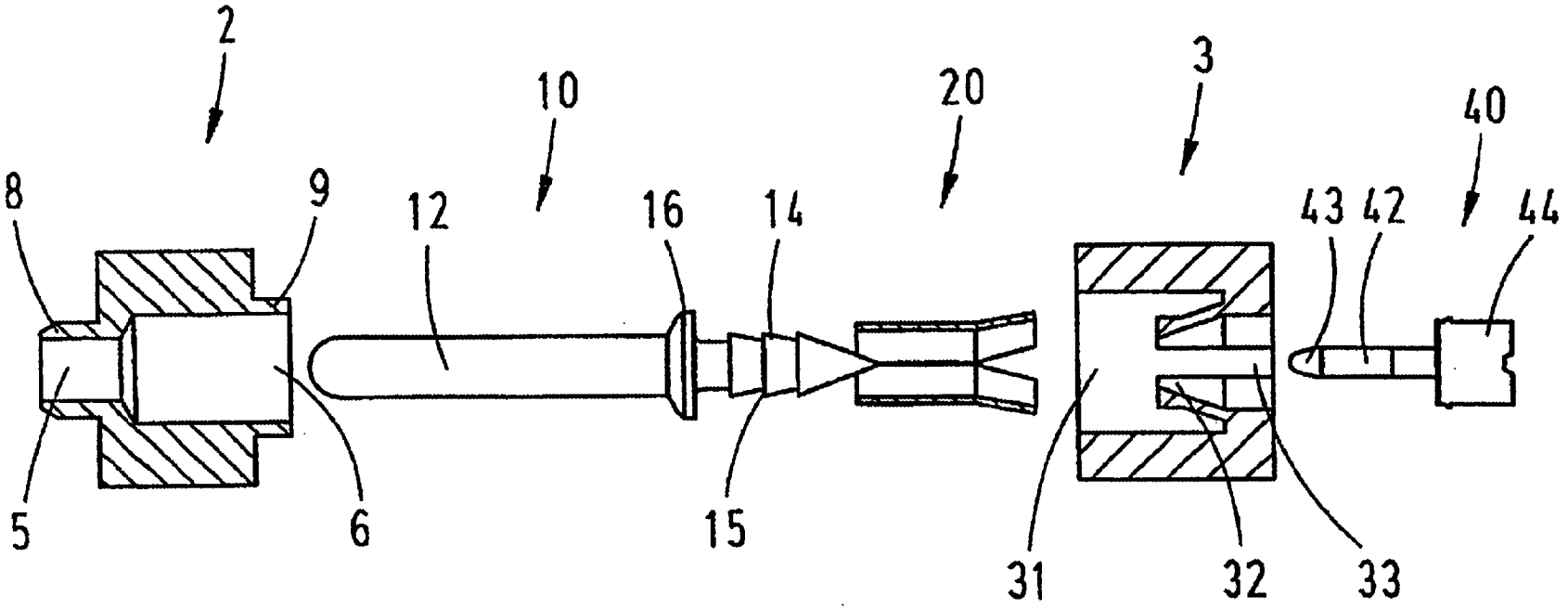

The invention relates to an electrical connection element, in particular a connection element in the form of a contact pin or contact tube disposed in an insulating housing and having a mating side and a connection end for contacting with an electrical conductor having a plurality of strands, and a housing for an electrical connection element.

Such connection elements are needed to establish an electrical connection between an electrical conductor having a plurality of strands and a connection end of an electrical contact pin or contact tube, whereby however no special tool is required.

For the connection of electrical conductors to a contact element a range of connection principles are technically known, such as the use of soldering, screw-type terminals, cage strain spring connection or alternatively crimp snap-on connectors.

The drawback here is that in the field of industrial connection technology various connection principles, such as soldering, are steadily losing ground on the basis of cost, that screw-type terminals as well as cage strain spring terminals take up a relatively large amount of room, and crimp snap-on connectors require in each case a special tool.

The object of the invention is therefore to design a connection element of the type described initially in such a way that a connection technique between an electrical conductor and a connection element is realized, which has contacting data, such as contact resistances and gas-tight connection points, which are at least comparable to a connection provided by a crimp snap-on connector, without however requiring the special crimping tool.

Said object is achieved in that the connection end has a contour shaped in a saw-tooth-like manner, wherein flanks directed at right angles to the mating direction are provided, that a resilient sleeve is slipped onto the connection end, that the sleeve is widened by means of a wedge element, and that the strands inserted into the space between the connection end and the sleeve as far as the stop are, after removal of the wedge, pressed with a radially effective force by the resilient sleeve into the saw-tooth-like contour.

Advantageous refinements of the invention are indicated in claims 2–4.

A further solution to the problem is such that the connection end has a contour shaped in a saw-tooth-like manner, wherein flanks directed at right angles to the mating direction are provided, that a sleeve is provided with two slots extending axially at 90° relative to one another, wherein segments are formed, which extend up to a back end, and wherein a hook-shaped portion is formed on the parts of the segments directed into the interior of the sleeve.

An advantageous refinement of said solution is indicated in claim 6.

A further object to the invention is to shape a simple low cost housing with a holding device for a safe hold of the electrical connection elements.

Said object is achieved that the insulating housing is formed by a mating-side housing part and a connection-end housing part, whereby an opening for receiving the sleeve with the pin contact inserted therein.

Advantageous refinements of said solution are indicated in claims 8–12.

The advantages achieved by the invention are in particular that a connection element in the form of a pin contact or contact tube is provided with a toothed connection end, which is embraced by a resilient sleeve. An electrical conductor having a plurality of strands, which is introduced between the connection end and the sleeve, is pressed by the effective spring force of the sleeve permanently onto the tips of the saw-tooth-like contour of the connection end, so that a vibration-proof connection between a contact element and the electrical conductor is achieved, which has a strength and contact stability almost identical to a crimp connection which, however, requires a special crimping tool.

It is moreover advantageous that the connecting capacity of electrical conductors for the connection element according to the invention covers a wider range of variation than is possible with a crimp connection.

Because of the small overall size a higher number of contacts is to be accommodated in the same space in a plug-in housing than is possible e.g. given the use of cage strain springs.

In said case, the contacting operation is advantageously designed in such a way that the sleeve, which is provided with a longitudinal slot, by means of a wedge element insertable therein has an enlarged diameter so that an electrical conductor having a plurality of strands is insertable between the connection end and the sleeve.

When the wedge element is removed, the resilient sleeve presses the strands onto the concentrically disposed teeth and/or into the interstices of the saw-tooth-like connection region so that by virtue of the tooth tips a mechanical undercut is formed, with the result that it is virtually impossible to pull the electrical conductor off or out of the sleeve.

A further advantage is the visual signalling of already fastened and/or not yet fastened electrical conductors in a plug-in housing comprising a plurality of connections: when all wedge elements project from the housing, then the corresponding electrical conductors are also firmly connected to the contact pins and/or contact tubes. In said case, it may advantageously be provided that the wedge elements are of a contrasting color to the housing.

In a variant a connection element is provided, which is refined in such a way that the contact pins or contact tubes may be directly inserted with the sleeve into an already known plug-in connector housing.

In a further variant a connection element is formed like a rolled sleeve in which the lateral surfaces are arranged overlapping, and a wedge opening at the one end of the sleeve is widened by means of the blade of a screwdriver. Thereby the edge of the lateral surface on the inside slides along the overlapping lateral surface, so that the strands within the sleeve do not arrive outward.

With said type of connection an identical-type, advantageously detachable connection is achievable, similar to a connection, which is achieved by a crimping operation but which is not detachable.

Figure 2:
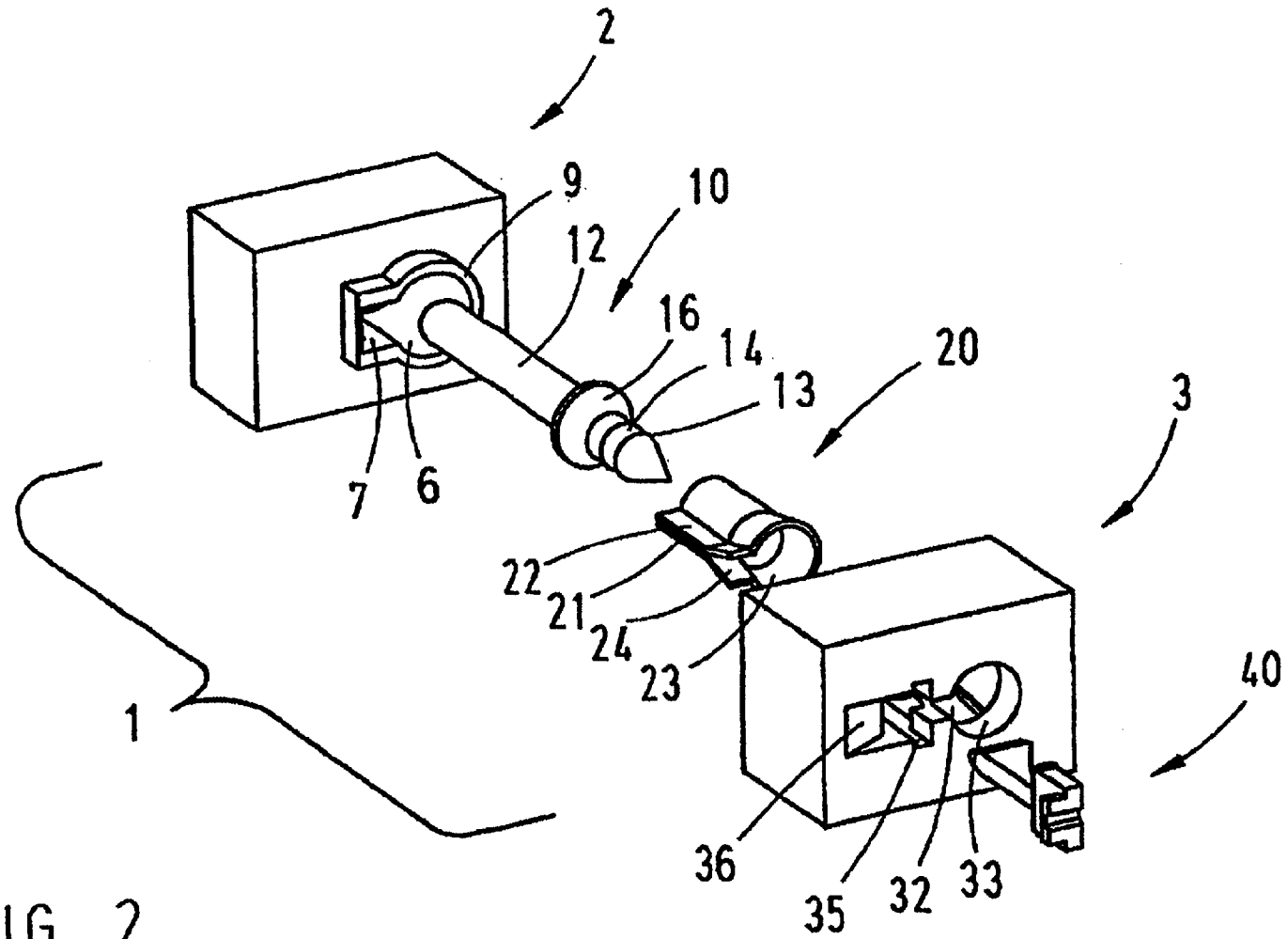
Figure 3:
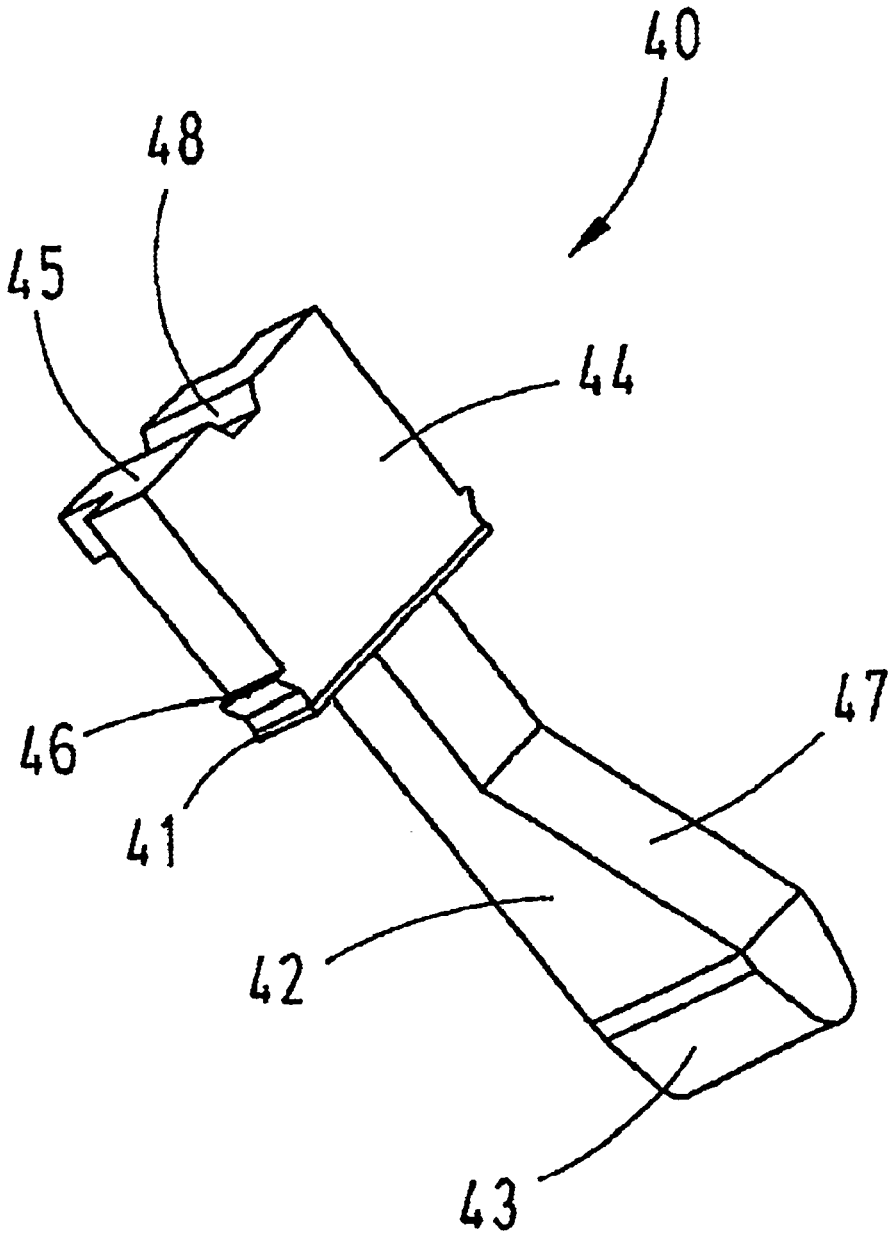
Figure 4:
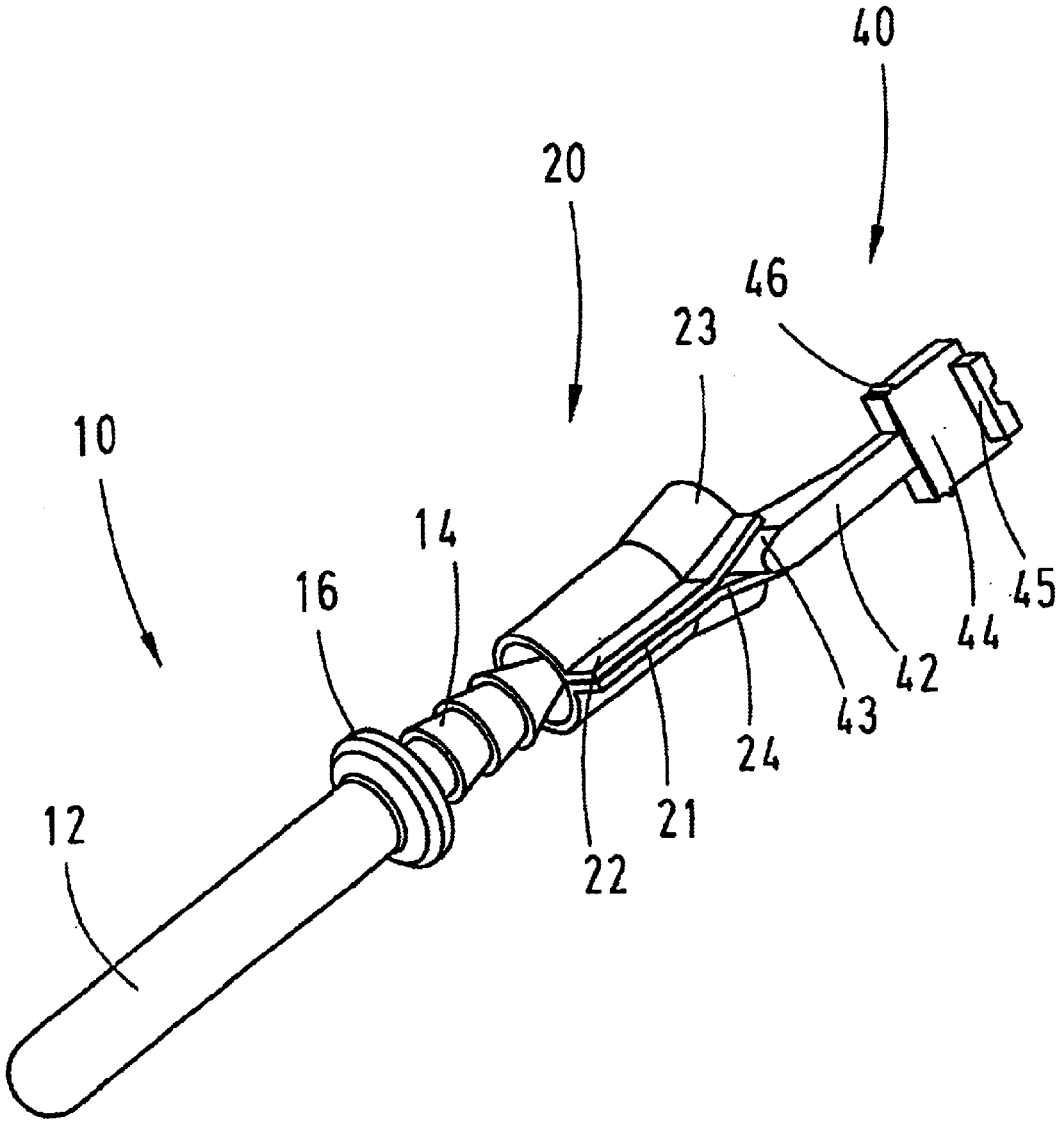
Figure 5A:
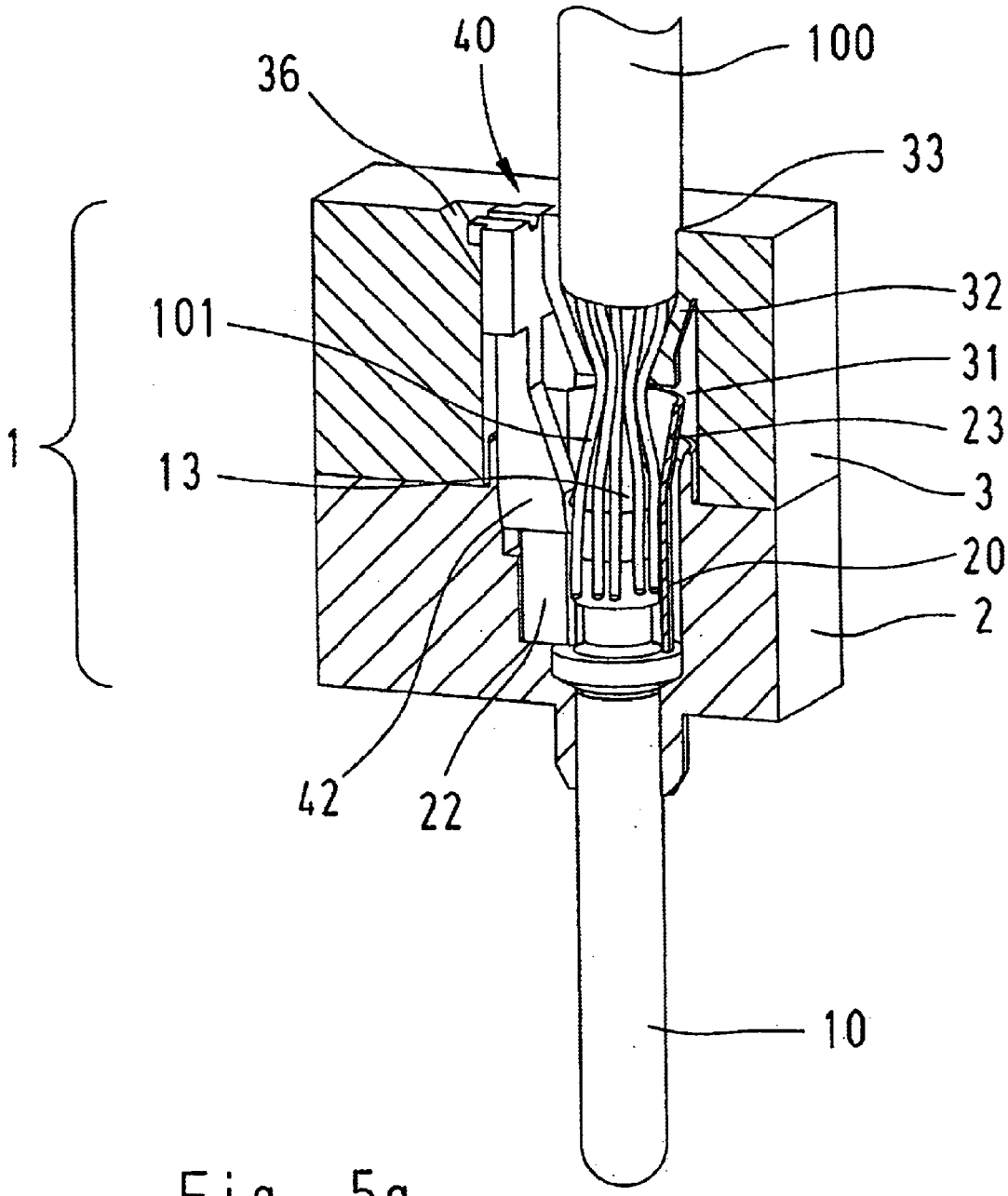
Figure 5B:
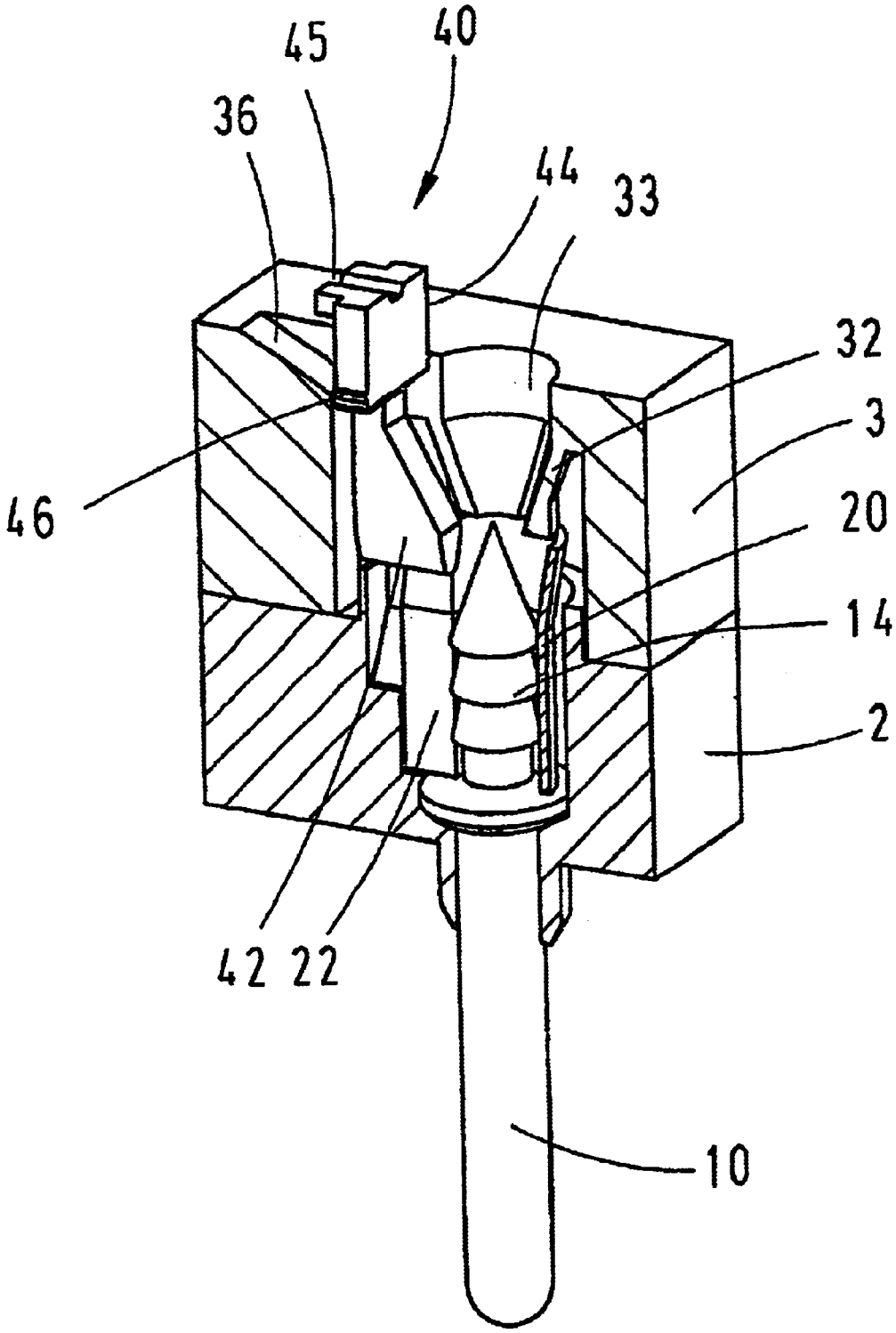
Figure 6:
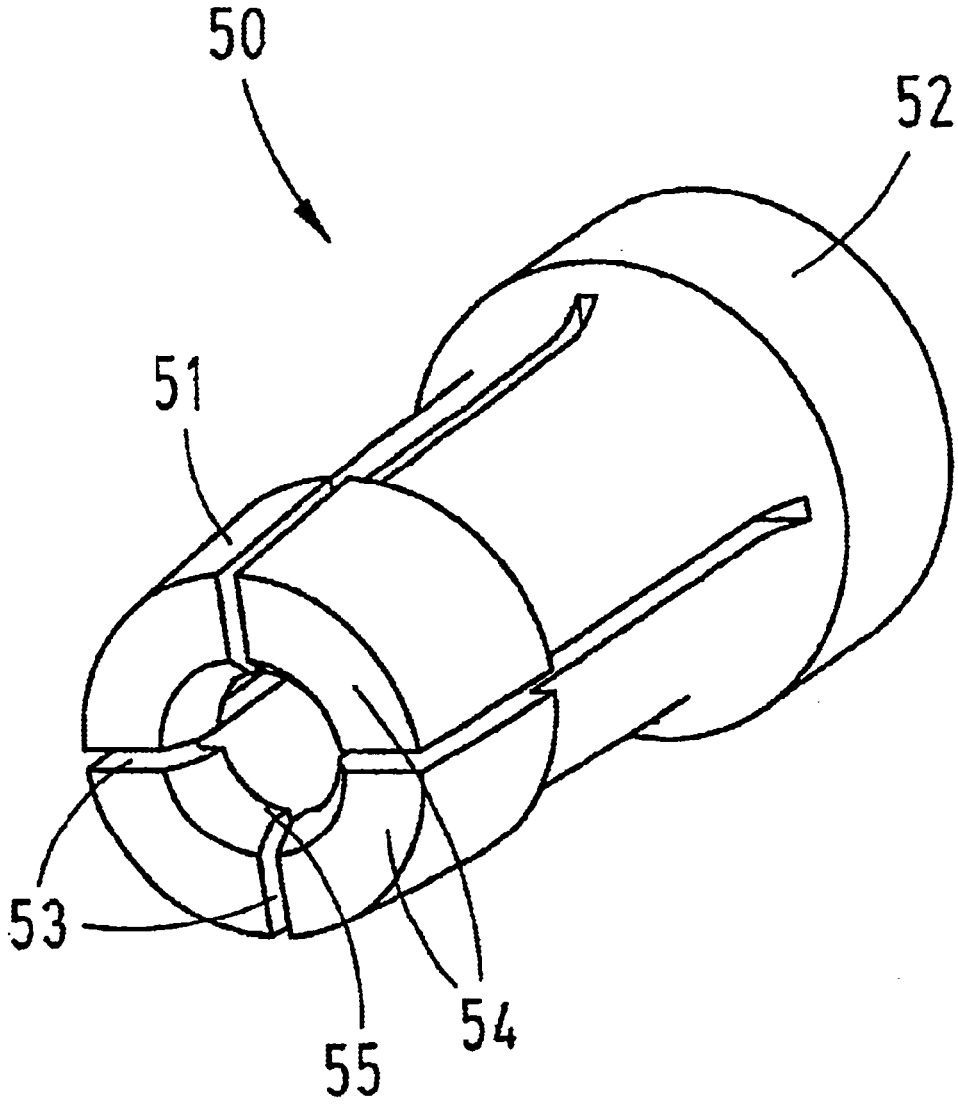
Figure 7:
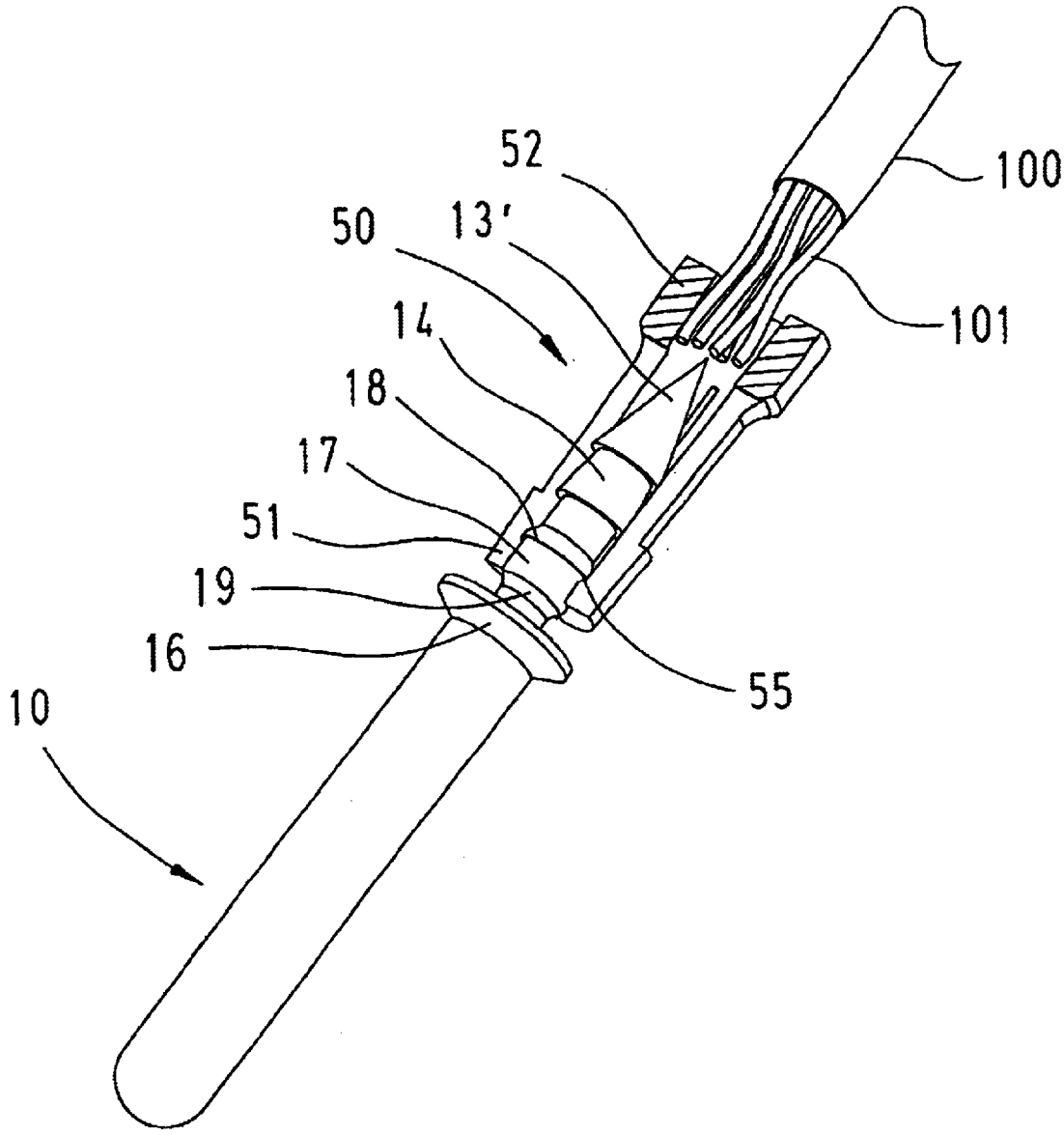
Figure 8:
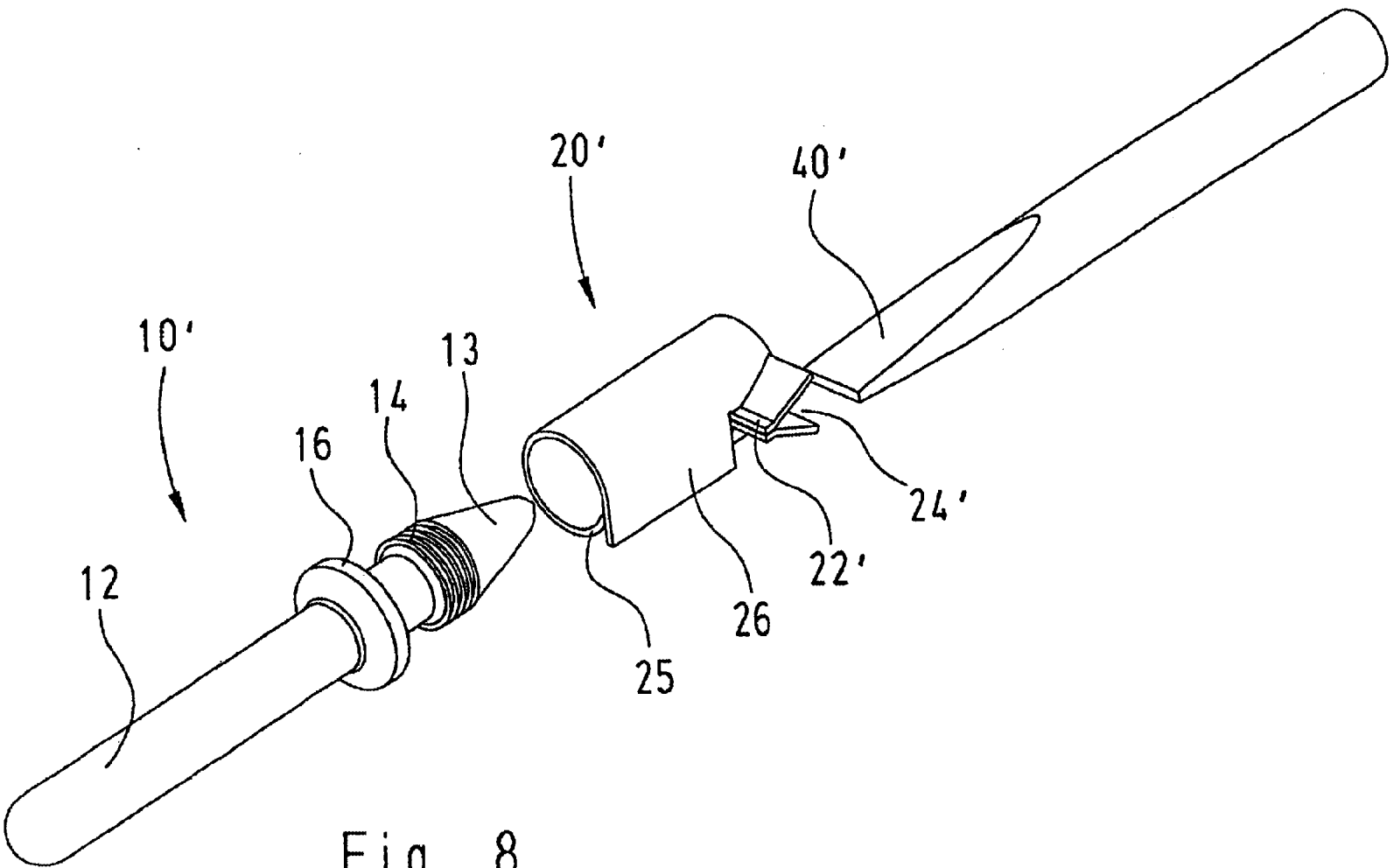

An embodiment of the invention is illustrated in the drawings and described in detail below. The drawings show:

FIG. 1 an exploded perspective view of a connection element with the corresponding housing parts, FIG. 2 a simplified sectional view of a connection element, FIG. 3 a perspective view of a wedge element, FIG. 4 a perspective view of a pin contact with a sleeve and a wedge element, FIG. 5*a* a perspective sectional view of the connection element with the wedge element pressed in, FIG. 5*b* a perspective sectional view of the connection element with the wedge element withdrawn, FIG. 6 a perspective view of a sleeve variant, FIG. 7 a partially exploded perspective sectional view of the sleeve variant with a pin contact variant, and FIG. 8 a perspective view of a further sleeve variant.

FIG. 1 and FIG. 2 shows an exploded (FIG. 1) and a sectional (FIG. 2) view of an individual connection element.

When a plurality of such connection elements are combined in an insulating housing, the result is known plug-in connections having a plurality of connection contacts arranged in rows and columns.

The illustrated example is a connection element in the form of a pin contact 10, which is inserted into an insulating housing 1, which in turn is formed by two housing parts 2, 3 that are joined together. A mating connector with corresponding contact tubes is equivalently provided but not shown here. The one housing part is the mating-side housing part 2, with openings 5, 6 for inserting the pin contact 10 with the sleeve 20, while in the second part, the connection-end housing part 3, an opening 31 for the funnel-shaped end of the sleeve as well as funnel-shaped lamellae 32 and an opening 33 for an electrical conductor are provided.

The two housing parts are connectable to one another and disposed one behind the other in such a way that the respective openings are mutually aligned.

In the mating-side housing part 2 the pin contact 10 is guided in an opening 5, which presents extended guidance by virtue of a ring-like formed-on portion 8.

The pin contact 10 is inserted up to its stop 16, a dish-shaped formed-on portion between the mating side 12 and the connection end 13, together with the sleeve 20 slipped on the connection end into the opening 5, 6, wherein the mating side 12 of the pin contact again projects at the mating side of the housing part 2.

The round opening 6 at the inside of the housing is in said case extended by a rectangular opening 7, into which the lateral strips 22 of the sleeve 20 project during the connector assembly. A raised annular contour 9 adapted to the two openings 6, 7 is moreover provided, which ensures an increase of the clearance and creepage distance as well as non-rotatable assembly of the two housing parts 2, 3.

A wedge element 40 is further provided, which in one variant is already connected during manufacture to the housing part 3 in the interior of the housing part by means of a thin material joint—a web 41—which, as will be described later, serves as a rupture joint. In another variant a separate wedge element is provided, which is not inserted into the housing part 3 until during assembly.

In the second part of the insulating housing, the connection-end housing part 3 shown in particular in FIG. 2, a through-opening is provided, which comprises different individual openings performing different functions.

For feeding the electrical conductor the opening 33 is provided, which is adjoined by an opening, which is formed in a funnel-shaped manner by lamellae 32 and projects into an extended opening 31, which in turn is provided for receiving the sleeve 20 as well as the annular contour 9 of the housing part 2.

In FIG. 3 the wedge element 40 is shown in a highly enlarged view. The wedge element substantially comprises two strips, which are rotated through 90° relative to one another and comprise a wedge 42 with a wedge tip 43 as well as the guide part 44 disposed in an offset manner.

Illustrated around the guide part in the edge region towards the wedge is a narrow circumferential web 41, which in a one-piece variant, housing part 3 and wedge element are manufactured in one injection molding operation, retains the wedge element inside the housing part 3.

Provided at each of the narrow sides of the guide part is an arresting lug 46, by means of which the wedge element is held captive inside the guide 35 of the housing part 3. The narrow side of the wedge 42 directed towards the sleeve 20 comprises a bevel 47.

Formed onto the guide part 44 is an end piece 45, which is bent at an angle and by means of which the wedge element may be pulled from or pressed into the housing part 3, wherein a groove 48 for inserting a screwdriver is provided in the outwardly directed side of the end piece.

The mode of operation of the wedge element 40 is as follows: in the ready-to-assemble state of the connection element the wedge element in one of the constructional variants is held by a rupture joint in the form of the web 41 inside the connection-end housing part 3. In said case, the end piece 45 of the wedge element terminates flush with the outer wall of the housing part 3. The pin contact 10 with the sleeve 20 mounted thereon is inserted inside the assembled housing 1. In said case, the wedge 42 passes between the wedge opening 24 of the sleeve 20 and widens the latter.

The side of the wedge 42 directed towards the sleeve is moreover adapted to the inside diameter of the sleeve 20 so that, when the strands are inserted, none of the individual strands may be inserted between the open lateral strips 22 of the sleeve.

With widening of the inside diameter of the sleeve the strands of an electrical conductor may easily be inserted into the annular cavity between the saw-tooth contour 14 of the connection end 13 of the pin contact and the sleeve 20.

After insertion of the strands the wedge element 40 is removed from the housing part 3 by pulling it out at the angled end piece 45.

In said case, a simple tool, e.g. the tip of a screwdriver, is inserted into the bevel 36 provided for said purpose in the housing part 3 and the wedge element is levered out, wherein the web 41 serving as a rupture joint ruptures. The wedge 42 is therefore removed from the region of the resilient sleeve 20 so that the latter contracts to its original diameter. In said case, the strands are pressed onto the saw-tooth contour 14 and/or into the interlying recesses so that by virtue of the undercut at the vertically descending flanks 15 of the saw teeth it is virtually impossible to pull off or remove the electrical conductor from the sleeve.

In another variant a separate manufactured wedge element 40, which differs in color as far as possible from the housing part 3, is merely inserted into the guide 35 and held captive by means of the arresting lugs 46.

FIG. 4 once more illustrates in a perspective view the mode of operation of the connection element comprising the elements of pin contact 10, sleeve 20 and wedge element 40, wherein the purely "digital behavior" of the system also becomes clear, which is such that either the wedge 42 is insertable by its wedge tip 43 between the lateral strips 22 of the longitudinal slot 21 and widens the sleeve or the resilient sleeve readopts its original state as soon as the wedge tip passes into the wedge opening 24 of the sleeve.

FIGS. 5*a* and 5*b* each show an individual connection element in a sectional view through assembled housing 1, comprising the housing parts 2, 3. Here, it may be seen how the pin contact 10 with the sleeve 20 mounted thereon is guided in the two housing parts 2, 3, wherein the lamellae 32 with a narrower diameter abut the funnel opening 23 of the sleeve. This has the advantage that the strands 101 of an electrical conductor 100 are initially focused by means of the lamellae, then encounter the conical connection end 13 of the pin contact and are then apportioned around the cone point into the gap between sleeve and connection end.

FIG. 5*a* reveals how the wedge 42 is inserted between the lateral strips 22 of the sleeve and therefore enlarges the sleeve diameter. During removal of the wedge, as shown in FIG. 5*b*, by means of a lever-like movement of a simple tool, which is introduced into the oblique recess 36 of the housing part 3 and in so doing engages behind the end piece 45 of the wedge element 40, the wedge element is levered out until the detent lugs 46 strike against the inner wall of the housing part 3. In said case, the resilient sleeve 20 retains its original narrow diameter and encloses the saw-tooth contour of the connection end 13 virtually without clearance. (See FIG. 4)

FIG. 6 shows a sleeve 50 for a connection element variant, which operates on the same principle but has its external structural shape adapted to a preexisting connector system so that said connection element may be used without difficulty and as a alternative for an already conventional contact tube or pin contact.

The sleeve 50 having a front end 51 and a larger-diameter back end 52, has two slots 53 extending axially at right angles to one another and running as far as the back end 52, thereby forming four spring segments 54, which are held together by the back end 52. In said case, the middle sub-portion between the front and back end is made smaller in diameter than the front end 51. The part of the front end 51 projecting into the sleeve interior is provided with a hook-shaped formed-on portion 55.

In FIG. 7 the sleeve 50 with a connection end variant 13' of the pin contact 10 is shown in section, wherein the sleeve is shown in the opened assembly state.

The sleeve in said case is opened by a mechanical deflection, which is provided at the connection end 13' and is formed by an axially parallel-running portion 17, which extends with a rounded-off portion to the necking 19. The diameter of the necking corresponds to the inside diameter of the hook-shaped formed-on portion 55 of the front end 51 of the sleeve, while the portion 17 has a larger diameter. The sleeve 50 is held under the tension of the four spring segments 54 on the portion 17 and is displaceable as far as the detent ring 18. An electrical conductor 100 having a plurality of strands 101 may be inserted as far as the stop 16 into the gap arising between the sleeve 50 and the saw-tooth-like contour 14.

After insertion of the strands 101 the sleeve is pushed axially in the same direction as the strands, until the hook-shaped formed-on portion 55 slides into the necking 19, wherein the sleeve cross section narrows again and the strands are pressed between the saw-tooth contour 14 and the inner wall of the sleeve 50.

The FIG. 8 shows a further variant with a single outward bent wedge opening 24' and a small lateral strip 22'. Afterwards to the wedge opening the sleeve has a lap 26. Thereby the external lateral surface of the lap 26 extends tangential over the edge of the surface on the inside 25 of the sleeve, whereby the edge closely rests upon the external lateral surface. When the sleeve 20' is widened by means of the blade 40' of a screwdriver inserted into the wedge opening 24' the edge of the lateral surface on the inside 25 slides along the external lateral surface 26, in which the longitudinal slot between the two lateral surfaces remains impenetrable for the strand wire inside the sleeve.

What is claimed is:

1. Electrical connection element, in particular a connection element in the form of a pin contact or contact tube disposed in an insulating housing and having a mating side and a connection end for contacting with an electrical conductor having a plurality of strands, wherein the connection end has a contour shaped in a saw-tooth-like manner, wherein flanks directed at right angles to the mating direction are provided, a resilient sleeve is slipped onto the connection end, the sleeve is widened by means of a wedge element, and the strands inserted into the space between the connection end and the sleeve as far as the stop are, after removal of the wedge, pressed with a radially effective force by the resilient sleeve into the saw-tooth-like contour.

2. Electrical connection element according to claim 1, wherein the sleeve made of a resilient material has a longitudinal slot, wherein two formed-on lateral strips directed outwards radially away from the sleeve are provided.

3. Electrical connection element according to claim 1, wherein the sleeve at one end has a funnel-shaped opening, which in the region of the lateral strips is designed as a wedge opening.

4. Electrical connection element according to claim 1, wherein the sleeve is made of a rolled sheet material whereby the one end of the sleeve seizing over the connection end of the pin contact or the contact tube is so formed that the lateral surface of the sleeve is arranged overlapping, whereby an edge of the lateral surface on the inside is pressed springly against an outside lateral surface, and the other end of the sleeve is formed with lateral projected lugs which are designed as a wedge opening in plug direction.

5. Electrical connection element, in particular a connection element in the form of a pin contact or contact tube disposed in an insulating housing and having a mating side and a connection end for contacting with an electrical conductor having a plurality of strands, wherein the connection end has a contour shaped in a saw-tooth-like manner, wherein flanks directed at right angles to the mating direction are provided, a sleeve is provided with two slots extending axially at 90° relative to one another, wherein segments are formed, which extend up to a back end, and wherein a hook-shaped portion is formed on the parts of the segments directed into the interior of the sleeve.

6. Electrical connection element according to claim 5, wherein the connection end of the pin contact is provided with a parallel-running portion, a necking and a detent ring.

7. Housing for an electrical connection element according to claim 1, wherein the insulating housing is formed by a mating-side housing part and a connection-end housing part, whereby an opening for receiving the sleeve with the pin contact inserted therein.

8. Housing for an electrical connection element according to claim 1, wherein provided in the housing part are lamellas disposed in a recess in a funnel-shaped manner to admit the sleeve.

9. Housing for an electrical connection element according to claim 1, wherein the housing art is a guide, in which the wedge element is guided by a guide part.

10. Housing for an electrical connection element according to claim 1, wherein the wedge element is connected to the housing part by a thin web designed as a rupture joint.

11. Housing for an electrical connection element according to claim 1, wherein the wedge element is designed as a separate part.

12. Housing for an electrical connection element according to claim 1, wherein the wedge element comprises an end piece, which is bent at an angle of 90° relative to the guide part and which engages into a recess, which is formed in the housing part and directed obliquely relative to the guide.

13. Housing for an electrical connection element according to claim 5, wherein the insulating housing is formed by a mating-side housing part and a connection-end housing part, whereby an opening for receiving the sleeve with the pin contact is inserted therein.

14. Housing for an electrical connection element according to claim 5, wherein the housing are lamellas disposed in a recess in a funnel-shaped manner to admit the sleeve.

15. Housing for an electrical connection element according to claim 5, wherein the housing part is a guide, in which the wedge element is guided by a guide part.

16. Housing for an electrical connection element according to claim 5, wherein the wedge element is connected to the housing part by a thin web designed as a rupture joint.

17. Housing for an electrical connection element according to claim 5, wherein the wedge element is designed as a separate part.

18. Housing for an electrical connection element according to claim 5, wherein the wedge element comprises an end piece, which is bent at an angle of 90° relative to the guide part and which engages into a recess, which is formed in the housing part and directed obliquely relative to the guide.

* * * * *